US007696854B2

(12) United States Patent
Rittstieg et al.

(10) Patent No.: US 7,696,854 B2
(45) Date of Patent: Apr. 13, 2010

(54) HEAVY CURRENT COUPLING

(75) Inventors: Henning Rittstieg, Nordheim (DE); Wolfgang Langhoff, Leonberg (DE)

(73) Assignee: Amphenol Tuchel Electronics GmbH, Heilbronn (DE)

( * ) Notice: Subject to any disclaimer, the term of this patent is extended or adjusted under 35 U.S.C. 154(b) by 332 days.

(21) Appl. No.: 11/546,411

(22) Filed: Oct. 12, 2006

(65) Prior Publication Data

US 2007/0085652 A1 Apr. 19, 2007

(30) Foreign Application Priority Data

Oct. 14, 2005 (DE) ..... 10 2005 049 134

(51) Int. Cl.
*H01H 85/04* (2006.01)
*H01H 85/00* (2006.01)
*H01H 71/20* (2006.01)
*H01H 85/143* (2006.01)

(52) U.S. Cl. ..... 337/159; 337/229; 337/142; 337/158; 337/144; 337/231

(58) Field of Classification Search ..... 337/158–159, 337/142, 144, 229, 231
See application file for complete search history.

(56) References Cited

U.S. PATENT DOCUMENTS 2,171,864 A * 9/1939 Popp ..... 337/234
2,556,018 A * 6/1951 Von Hoorn ..... 337/233
2,777,033 A * 1/1957 Kozacka ..... 337/159
2,816,989 A * 12/1957 Sugden ..... 337/292
3,256,409 A * 6/1966 Brandt ..... 337/161
3,849,755 A * 11/1974 Blewitt et al. ..... 337/295
4,117,441 A * 9/1978 Wycklendt ..... 337/295
4,319,213 A * 3/1982 Reid ..... 337/161
4,358,747 A * 11/1982 Zlupko et al. ..... 337/273
4,583,069 A * 4/1986 Pierce ..... 337/240
4,973,932 A * 11/1990 Krueger et al. ..... 337/164
5,345,210 A * 9/1994 Swensen et al. ..... 337/163
5,892,427 A * 4/1999 Handcock ..... 337/229

* cited by examiner

*Primary Examiner*—Jayprakash N Gandhi
*Assistant Examiner*—Bradley H Thomas
(74) *Attorney, Agent, or Firm*—Blank Rome LLP

(57) ABSTRACT

A heavy current coupling that includes an electrically conductive elastic fastening and fuse element supported by the housing. The fastening and fuse element is configured to electrically connect first and second contacts, with the first and second contacts being spaced from one another. Wherein the fastening and fuse element burns through when a predetermined maximum current is exceeded, thereby interrupting the electrical connection between the first and second contacts.

15 Claims, 6 Drawing Sheets

HEAVY CURRENT COUPLING

RELATED APPLICATION

This application claims priority under 35 U.S.C. §119 to German Patent Application No. 10 2005 049 134.0, filed Oct. 14, 2005, the subject matter of which is herein incorporated by reference.

FIELD OF THE INVENTION

The invention relates to a heavy current coupling for two electrical connectors, such as plugs. Heavy currents are defined as electrical currents with current intensities of more than roughly 10 Amps.

Heavy current fuses between two electrical contacts and within cable sets are necessary to protect electrical components against overly high current intensities. In motor vehicles, for example, heavy current fuses are typically mounted on a power distribution bar in the motor vehicle either by means of bolts and nuts, or inline fuses are mounted directly in the cable set. The contact zones of the heavy current fuse and inline fuses are each fixed on one bolt. Conventionally, in order to connect electric lines to the contact zones of the heavy current fuse in an electrically conductive manner, metallic ring eyes are crimped on the ends of the electric lines and at the same time these ring eyes are slipped onto threaded bolts. The connection is then fixed by screwing nuts onto the bolts. In this installation process sufficient tightening torque must be applied to ensure a low contact resistance between the ring eyes and the contact zones of the heavy current fuse. Generally the heavy current fuse can be protected by a correspondingly suitable housing which can be installed as an additional component. In that case, the threaded bolts may break out of their surrounding plastic housing or the housing may be damaged during installation. It is therefore necessary to monitor the torque for the installation process.

SUMMARY OF THE INVENTION

Accordingly, an object of the invention is to provide an improved and simplified heavy current fuse, which can make contact with electrical conductors. In general, the invention integrates a heavy current fuse into a coupling for electrical contacts, such as a plug-in contacts. A detachable electrical contact-making function and a protection function may be implemented in a common module.

The heavy current fuse may have a housing into which two contacts may be connected or plugged. Within the housing there may be a common, elastic fastening element for detachable fixing of the contacts within the housing. The elastic fastening element is electrically conductive to provide an electrical connection between the two contacts. The contacts themselves may be spaced from one another so that the contacts do not directly touch one another, such that there is no electrical contact between the contacts. The electrically conductive, common and elastic fastening element may be used with the heavy current fuse. The fastening element may be made such that when a given maximum current is exceeded, the fastening element fails in a specific manner, such as by burning through. The current flows between the two contacts via their respective contact points with the elastic fastening element. The desired, maximum current-carrying capacity of the fastening element can be limited by a suitable geometrical layout, or optionally in combination with auxiliary methods, such as, for example, partial galvanization and additional perforation or partially punching out of the fastening element. A housing in addition to the fastening and fuse element can be omitted.

By integrating the fuse functionality into the heavy current coupling, the need for additional parts, such as bolts and nuts, a housing, and process steps, such as tightening screws, etc. is eliminated. In addition, the overall required installation space is reduced. The heavy current coupling can be replaced in a controlled manner with extremely simple tools if necessary or not. Accordingly, fault sources due to improper mounting are avoided, for example by insufficient tightening torque. The number of possible plugging cycles is maximized by the elastic configuration.

For example, the fuse and fastening element may be made such that it burns through a maximum current intensity of greater than 100 Amps, preferably roughly between 200 Amps and 300 Amps. Also, the maximum current intensity may be about 60 to 80 Amps.

In one configuration of the invention, the fastening and fuse element may be made as a sleeve-shaped clamping element with two contact openings, the clamping element radially accommodating the two contacts by clamping. The two contacts are preferably inserted in the opposite directions into the elastic fastening and fuse element, the fastening and fuse element radially and elastically adjoining and clamping the two contacts. The current flows between the two spaced contacts via the fastening and fuse element. The fastening and fuse element is designed such that it fails when a given maximum current is exceeded.

The fastening and fuse element may be generally shaped like a hyperbola to provide a fitted configuration in which the contacts are clamped. By means of the waisted form an inwardly directed radial force against the fastening and fuse element is effected in order to clampingly engage the fastening fuse element.

In one preferred embodiment, the fastening and fuse element may be made as a bar grid with several bars spaced apart in the peripheral direction. In the hyperbola configuration of the fastening and fuse element, the bars may be axially offset to one another and spaced more closely in the middle in their position among one another, to form the shape of the hyperbolically elastic cage. By varying the number, thickness and geometry of the bars spaced apart from one another, the maximum current-carrying capacity of the fastening and fuse element and thus of the heavy current fuse can be set, by which it is possible to adapt the fuse characteristic to the respective application.

For stability of the contacts, the fastening and fuse element may be held by an especially cylindrical, preferably non-conductive sleeve within the housing. The sleeve stabilizes the fastening and fuse element in the axial direction. In doing so, the sleeve can be held either directly on a surrounding housing, or indirectly via the fastening and fuse element on such a housing. The sleeve may be glass, ceramic or any electrically non-conductive plastic and with a suitable configuration can therefore be used as the housing itself.

For additional stabilization of the contacts, an electrically nonconductive, preferably centrally arranged fixing pin is provided. With the contacts inserted, the fixing pin projects axially into the two contacts. Preferably, the fixing pin applies a clamping force to the two contacts in the radial direction. The additional fixing pin makes it possible to provide only a small number of bars for electrically conductive and elastic fixing of the two contacts. The smaller the number of bars used, the smaller the clamping force of the fastening and fuse element. The use of only a small number of bars may be desirable, for example, when the maximum current-carrying capacity is to be relatively small.

In addition to the electrically conductive elastic fastening element a catch means for locking the contacts on the heavy current coupling may be provided. Generally they are non-conductive catch means which ordinarily lock the contact housing to the housing of the heavy current coupling or the sleeve. After release of the catch means, the inserted contacts can be pulled out of the housing of the heavy current coupling.

To ensure that the two contacts do not touch directly, there is preferably provided an axial stop, especially on the coupling housing. The contact, especially with its housing or a stop contour molded on the contact, runs onto this axial stop, so that the maximum insertion depth into the coupling housing is limited. The front surfaces of the contacts which are to be electrically coupled are spaced and do not directly contact each other. An axial stop may be formed by the fastening and fuse element and/or the electrically non-conductive sleeve for fixing the fastening and fuse element.

Alternatively or additionally to the axial stop, there can be an electrically non-conductive spacer between the contacts. The spacer can be attached, for example, to the front surfaces of the contacts and can be inserted into the heavy current coupling by means of the contacts. Alternatively, the spacer can be held within the heavy current coupling, for example, on the housing or on the sleeve.

It is conceivable for the heavy current coupling to be integrated into the housing of the contact so that one opening remains free within the housing for making contact with another contact. Here it is possible to make the housing of the heavy current coupling integral with the housing of the contact. In exactly the same manner, it is possible to provide an additional, secondary housing especially for detachable fixing of the heavy current coupling on the plug housing.

Objects, advantages and salient features of the invention will become apparent from the following detailed description, which, taken in conjunction with the annexed drawings, discloses preferred embodiments of the present invention.

BRIEF DESCRIPTION OF THE DRAWINGS

These and/or other aspects of the present invention will become apparent and more readily appreciated from the following description of the embodiment, taken in conjunction with the accompanying drawings of which.

DETAILED DESCRIPTION OF THE EXEMPLARY EMBODIMENTS

In the figures the same components and components with the same function are provided with the same reference numbers.

Figure 1:
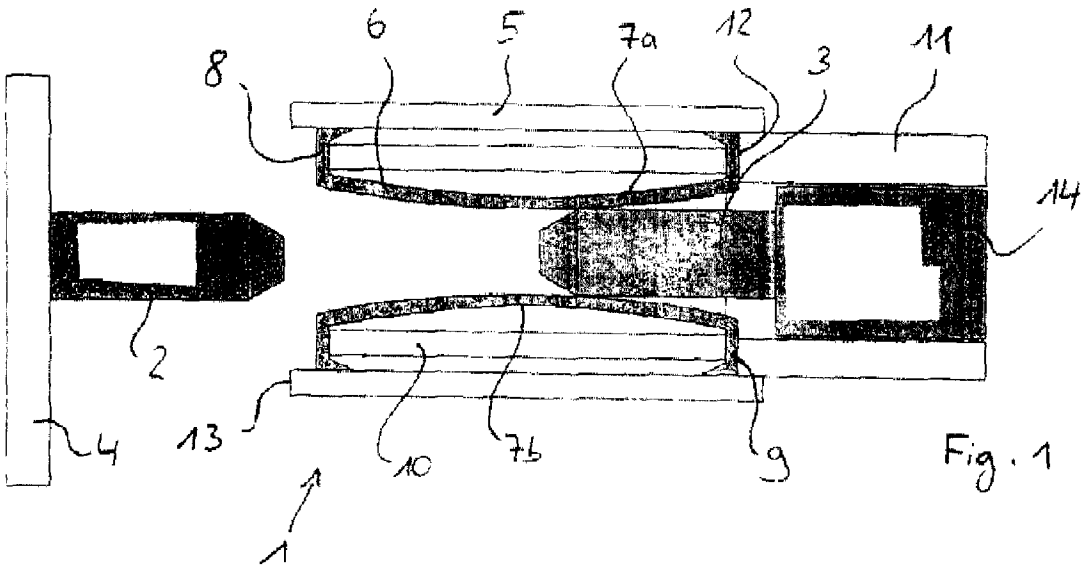
FIG. 1 is a side elevational view of a heavy current coupling in accordance with the present invention, showing the coupling with an inserted contact.

FIG. 1 shows a heavy current coupling 1 for a first contact 2 and a second contact 3. The contacts 2 and 3 may be standard pins. The first contact 2 may be mounted on a bracket 4. Electrical linking of the first contact 2 takes place via printed conductors, which are not shown.

Figure 2:
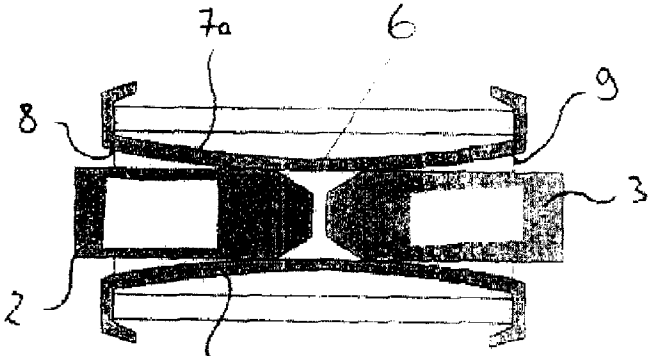
FIG. 2 is a side elevational view of a fastening and fuse element of the heavy current coupling, as shown in FIG. 1, with two inserted contacts.

The heavy current coupling 1 may be a cylindrical, sleeve-shaped housing 5 of electrically non-conductive plastic. Within the housing 5 there may be an electrically conductive and elastic fastening and fuse element 6. The plugs 2 and 3 in their inserted state are electrically connected to one another by the fastening and fuse element 6, as shown in FIG. 2.

The fastening and fuse element 6 may be sleeve-shaped and may have a generally hyperbola shape, i.e. a fitted waisted shape. The sleeve-shaped fastening and fuse element 6 may be made as a bar grid with several clamping members or bars 7*a*, 7*b* and 7*c* spaced apart in the peripheral direction. The electrically conductive bars 7*a*, 7*b* and 7*c* (FIG. 3) extend longitudinally between two peripheral rings 8 and 9. The rings 8 and 9 are radially supported on the inside of the housing 5. The rings 8 and 9 are preferably made of metal and integrally with the bars 7*a*, 7*b* and 7*c*. For axial stabilization of the fastening and fuse element 6, a sleeve 10 is provided that is preferably made of non-conductive material. The sleeve 10 may be arranged coaxially with respect to the housing 5 and within the housing 5.

FIG. 1 shows that the second contact 3 may have a housing 11. The housing 11 may be inserted into the housing 5 of the heavy current coupling 1. The housing 5 overlaps the housing 11. The housing 11 preferably lies axially against an axial stop 12 formed by the fastening and fuse element 6 and thus limits the maximum penetration depth of the contact 3 into the heavy current coupling 1. This is necessary so that the two contacts 2 and 3 do not directly touch one another, so that the electrical connection is provided exclusively by the fastening and fuse element 6. On the opposite side, a second axial stop 13 may be formed by the front surface of the housing 5. When the contact 2 is inserted, the bracket 4 rests on the axial stop 13. A catch means (not shown) for fixing the housing 11 on the housing 5 of the heavy current coupling 1 may be provided. Within the housing 11, the contact 3 is connected to the electrically conductive cable 14.

The number and thickness of the bars 7*a*, 7*b* and 7*c*, are such that the fastening and fuse element 6 and the bars 7*a*, 7*b* and 7*c* burn through when a maximum current is exceeded, thereby breaking the electrically conductive connection between the contacts 2 and 3. The heavy current coupling 1 can then be replaced, such as by hand without using an additional tool.

FIG. 2 shows the radially elastic contacts 2 and 3 which have been inserted into the radially elastic fastening and fuse element 6. The axial distance between the two contacts 2 and 3 is such that the formation of an electrical arc is precluded at the prevailing current intensities. If the flowing current exceeds a given maximum current intensity, the bars 7*a*, 7*b* and 7*c* burn through, thereby interrupting the current flow (FIG. 2 shows only bars 7*a* and 7*b*).

Figure 3:
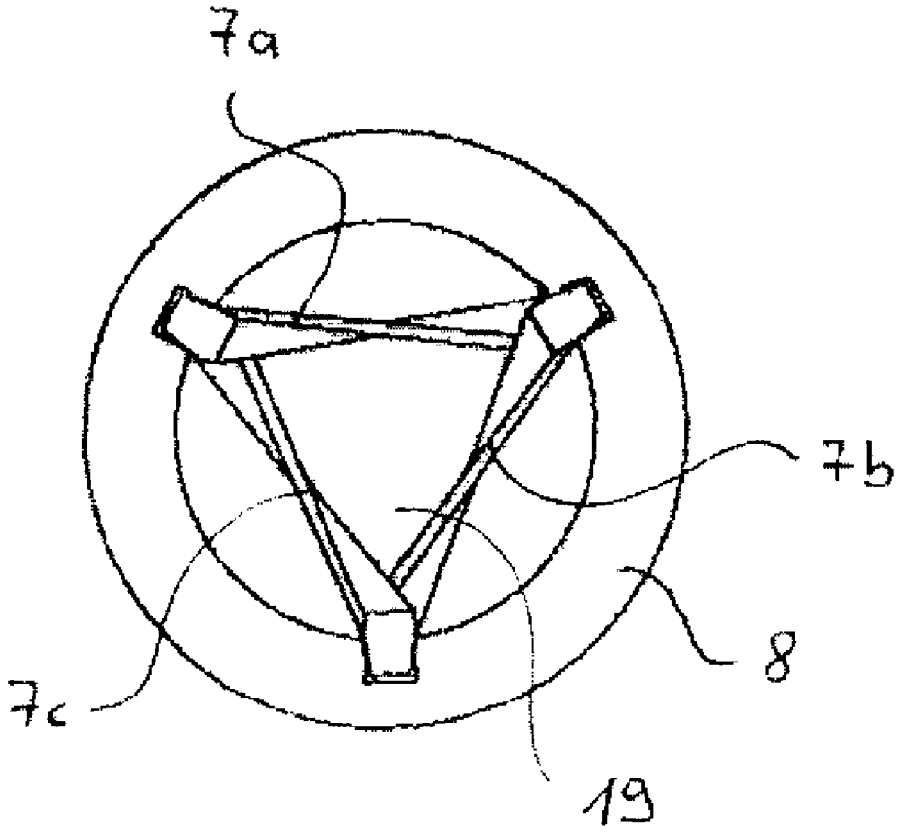
FIG. 3 is a top plan view of the fastening and fuse element shown in FIG. 2.

FIG. 3 shows a top view of the fastening and fuse element 6 in the insertion direction. The electrically conductive bars 7*a*, 7*b*, 7*c* which are suspended with the same distance to one another on the rings 8 and 9 are shown, the second ring 9 being hidden by the ring 8. The rings 8 and 9 in this embodiment may be made of an electrically non-conductive material. A contact can be inserted between the bars 7*a*, 7*b*, and 7*c* into the ring opening 19. The bars 7*a*, 7*b*, and 7*c* are made elastic and radially clamp the plug.

Figure 4:
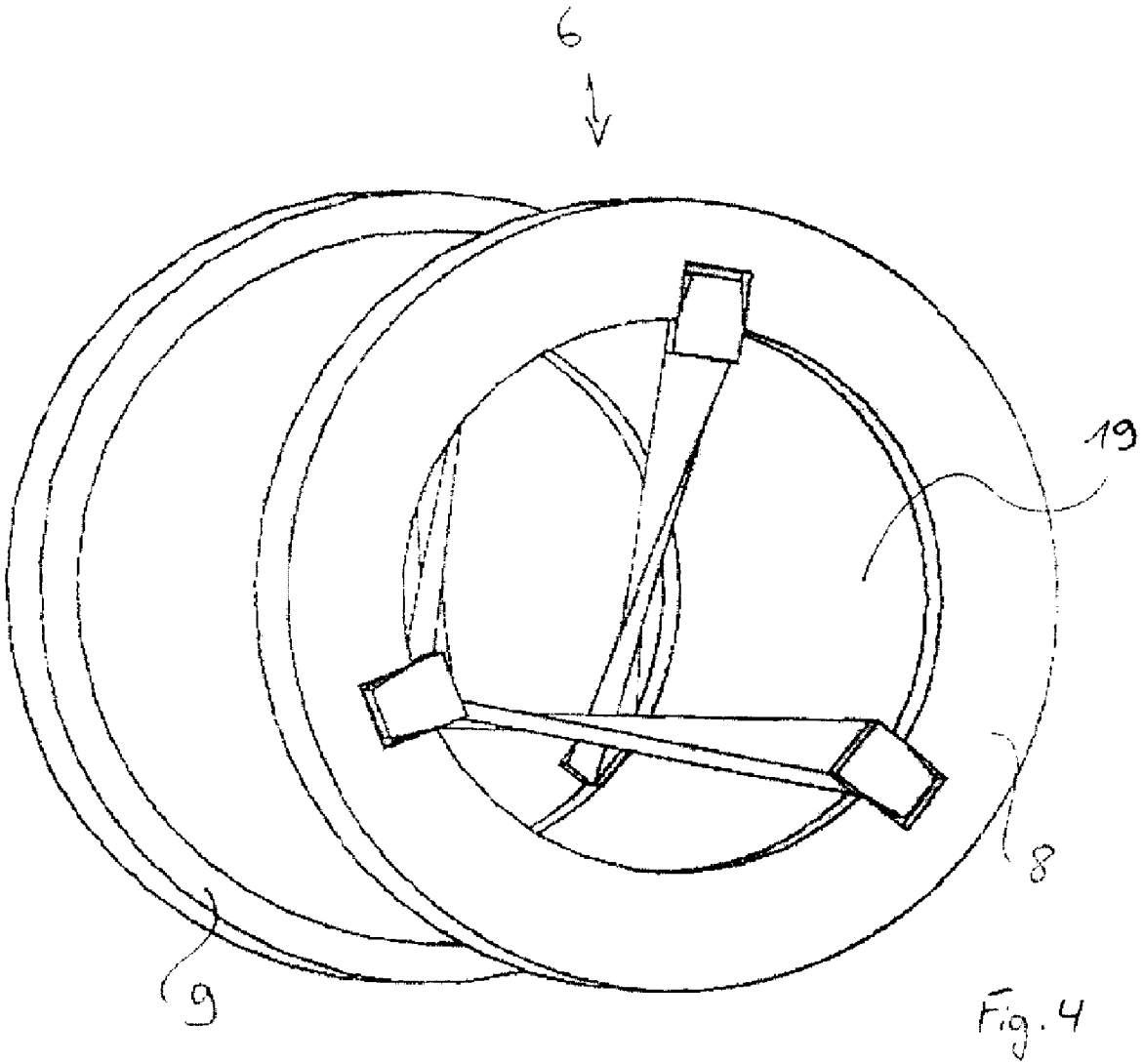
FIG. 4 is a perspective view of the fastening and fuse element, as shown in FIG. 3.

FIG. 4 shows the fastening and fuse element 6 in perspective view. Bars 7*a*, 7*b*, and 7*c* which preferably yield a generally three-dimensional, rotationally-symmetrical and hyperbolic shape, and which are held on the axially spaced rings 8 and 9 are shown. The hyperbola shape is achieved by twisting the bars 7*a*, 7*b*, and 7*c* in the peripheral direction over their axial length. The bars may be offset by 120° in the peripheral direction between the two rings 8 and 9. The rings 8 and 9 may be supported by the sleeve 10, for greater stability. The sleeve 10 may be made of glass. When a maximum current is exceeded, all the bars 7*a*, 7*b*, and 7*c* burn through, thereby interrupting the current flow. Although three bars 7*a*, 7*b*, and 7*c* are preferred, any number of bars may be used, including a single bar.

Figure 5:
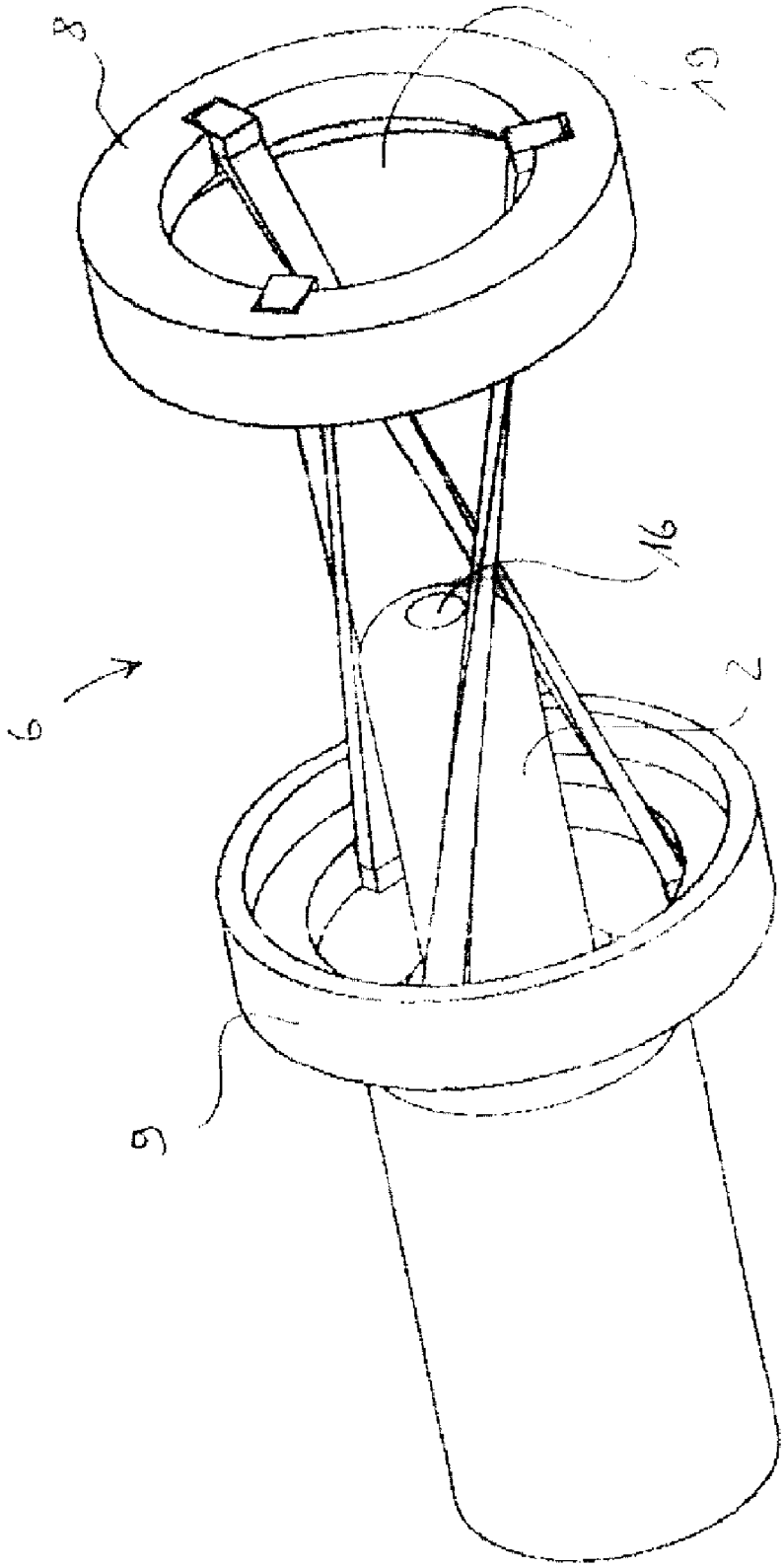
FIG. 5 is a perspective view of the fastening and fuse element, as shown in FIG. 3 and FIG. 4, with a contact inserted therein.

FIG. 5 shows the fastening and fuse element 6 according to FIG. 4 with contact 2 inserted therein. The bars 7*a*, 7*b*, and 7*c* radially adjoin the contact 2 and clamp it. Contact 2 may include an end opening 16.

Figure 6:
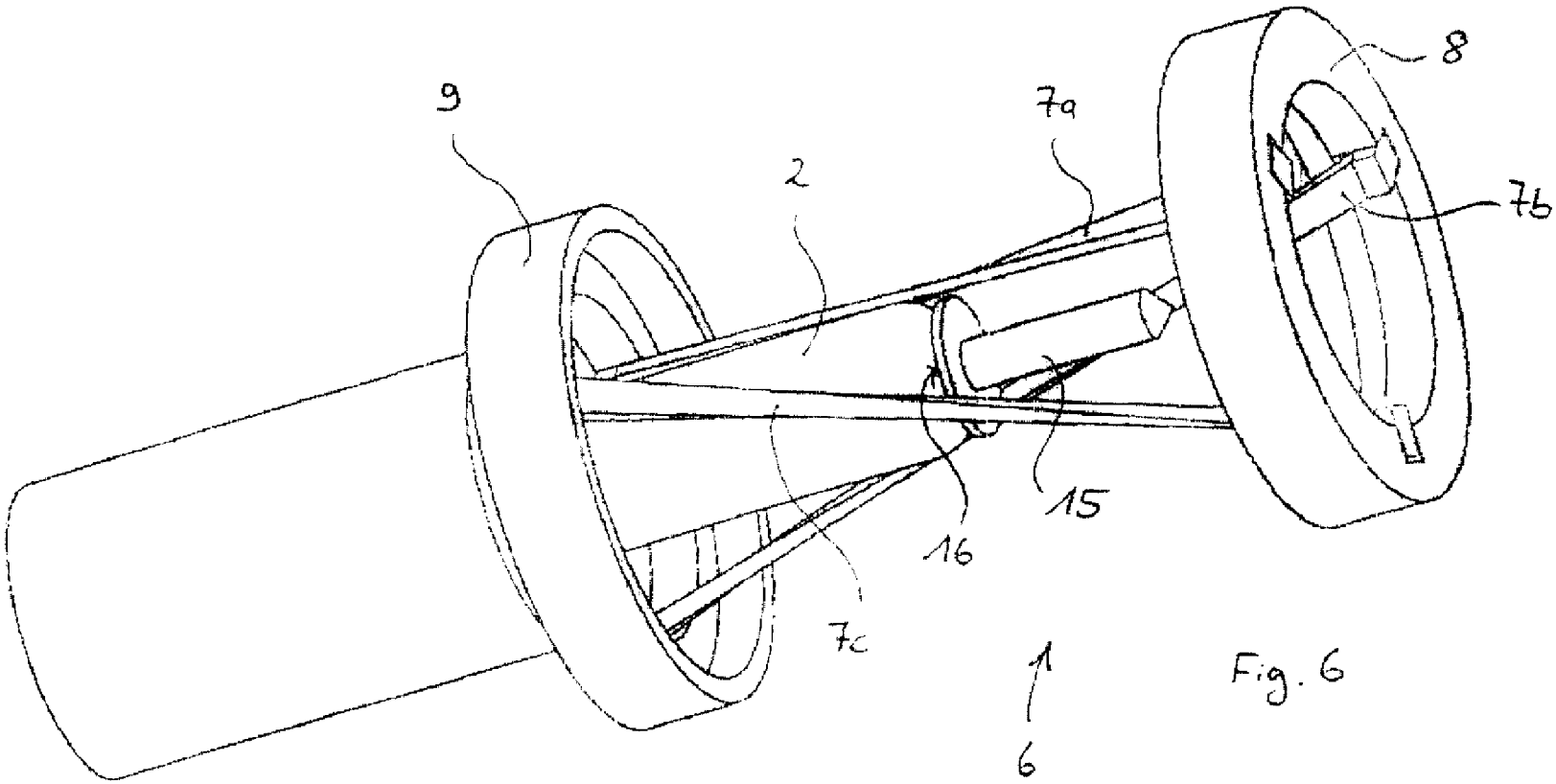
FIG. 6 is a perspective view of an alternative embodiment of the fastening and fuse element including a center fixing pin.
Figure 7:
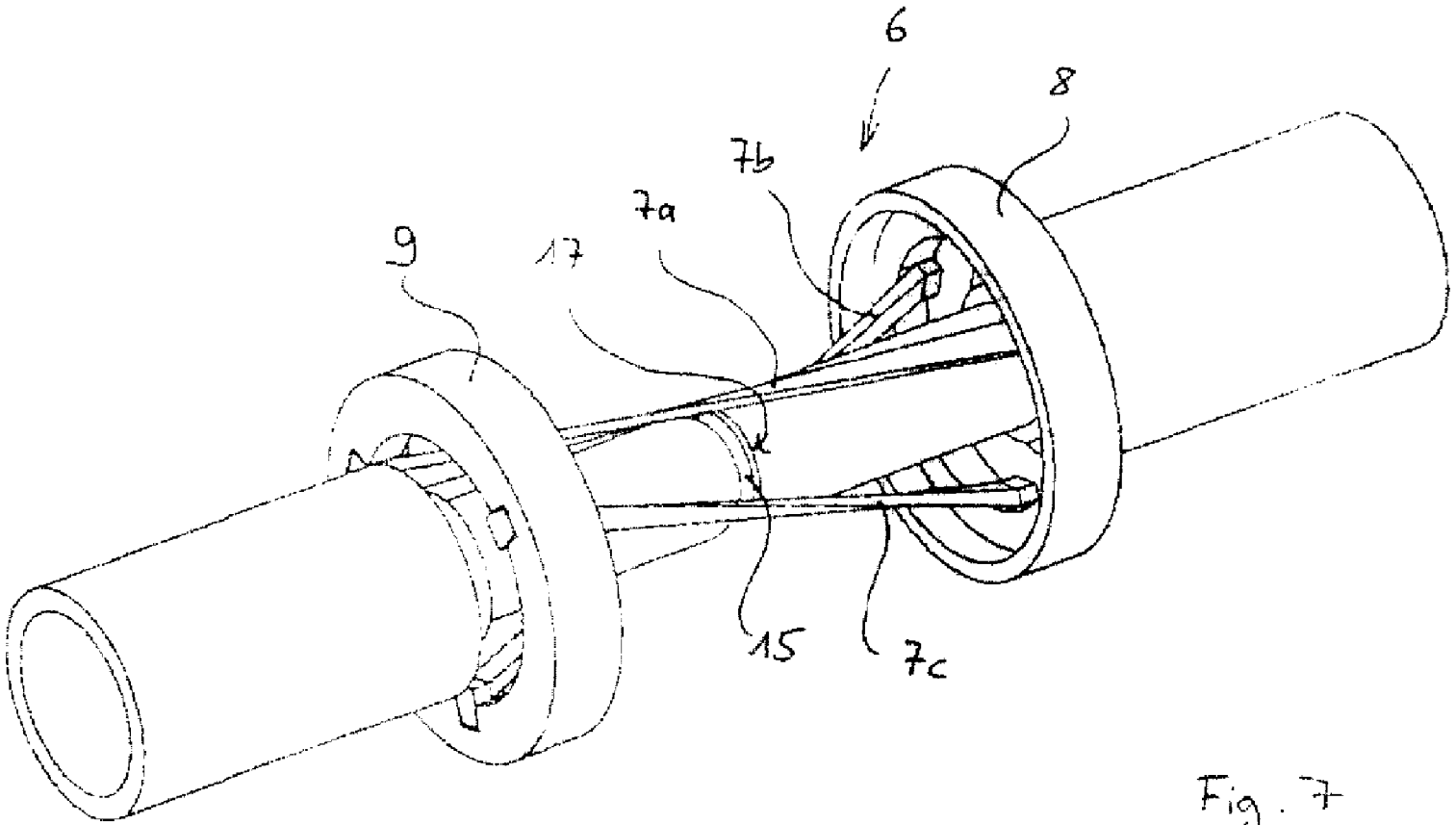
FIG. 7 is a perspective view of the fastening and fuse element as shown in FIG. 6, with two inserted contacts.

FIG. 6 shows an alternative embodiment of the fastening and fuse element 6'. On the longitudinal axis of the fastening and fuse element 6', an electrically non-conductive center fixing pin 15 may be provided onto which the contact 2 with its end opening 16 is slipped. The fixing pin 15 may be widened in the middle to form a spacer holder for the contacts plugs 2 and 3. The two contacts 2 and 3 with their axial respective openings 16 and 17 may be slipped onto the fixing pin 15, as seen in FIG. 7.

The fixing pin 15 is used for additional fixing and guidance of the two contacts 2 and 3 within the housing. If the number of bars of the fastening and fuse element 6' is so small that sufficient radial clamping of the two contacts 2 and 3 cannot be ensured solely using the bars 7*a*, 7*b*, 7*c*, then the fixing pin can provide additional coupling.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heavy current coupling, comprising of:

two contact rings forming two contact openings for receiving first and second contacts, an electrically conductive elastic fastening and fuse element extending longitudinally between said two contact rings, said fastening and fuse element being configured to electrically connect said first and second contacts, with said first and second contacts being spaced from one another, wherein said electrically conductive fastening and fuse element is a sleeve-shaped clamping element including said two contact openings, said clamping element being made to radially clamp said first and second contacts upon insertion of said first and second contacts in said two contact openings; and wherein said fastening and fuse element burns through when a predetermined maximum current is exceeded, thereby interrupting the electrical connection between said first and second contacts.

2. A heavy current coupling as claimed in claim 1, wherein said two contact openings are opposed to one other such that a continuous open plug contour is provided.

3. A heavy current coupling as claimed in claim 1, wherein said fastening and fuse element has generally a hyperbolic shape.

4. A heavy current coupling as claimed in claim 1, wherein said fastening and fuse element includes a plurality of spaced apart clamping bars.

5. A heavy current coupling as claimed in claim 4, wherein said bars form a hyperbola.

6. A heavy current coupling, as claimed in claim 4, wherein at least one of said plurality of bars is provided with at least a partial surface coating.

7. A heavy current coupling, as claimed in claim 1, wherein said fastening and fuse element is held by a substantially cylindrical sleeve.

8. A heavy current coupling, as claimed in claim 7, wherein said sleeve is non-conductive.

9. A heavy current coupling as claimed in claim 1, further comprising an electrically non-conductive fixing pin onto which said first and second contacts are slipped.

10. A heavy current coupling as claimed in claim 1, further comprising an axial stop formed on a housing, for limiting the insertion depth of said first and second contacts into said fastening and fuse element.

11. A heavy current coupling as claimed in claim 1, further comprising an axial stop formed on said fastening and fuse element for limiting the insertion depth of said first and second contacts into said fastening and fuse element.

12. A heavy current coupling as claimed in claim 1, wherein there is at least one electrically non-conductive spacer between said first and second contacts.

13. A heavy current coupling as claimed in claim 1, wherein the predetermined maximum current intensity is greater than 30 Amps.

14. A heavy current coupling as claimed in claim 1, wherein the predetermined maximum current intensity is about 60 Amps to 80 Amps.

15. A heavy current coupling as claimed in claim 1, wherein one of said first and second contacts includes a contact housing that engages a housing.

* * * * *